United States Patent [19]

Lo

[11] Patent Number: 4,945,815

[45] Date of Patent: Aug. 7, 1990

[54] PNEUMATIC TYPE OF RECIPROCATING MOVEMENT DEVICE

[75] Inventor: Shih-Dean Lo, Hsin Chu Hsien, Taiwan

[73] Assignee: Industrial Technology Research Institute, Hsin Chu Hsien, Taiwan

[21] Appl. No.: 198,438

[22] Filed: May 25, 1988

[51] Int. Cl.[5] ..... F01L 21/02

[52] U.S. Cl. ..... 91/234; 91/276; 91/325; 92/106

[58] Field of Search ..... 91/232, 233, 234, 276, 91/325, 423; 92/3, 106

[56] References Cited

U.S. PATENT DOCUMENTS

| | | | |
|---|---|---|---|
| 608,953 | 8/1898 | Carlinet | 91/234 X |
| 884,152 | 4/1908 | Hardsocg | 91/234 X |
| 1,245,603 | 11/1917 | Lewis | 91/234 X |
| 1,940,143 | 12/1933 | Overly | 91/232 X |
| 2,763,060 | 9/1956 | Swanson | 91/234 X |
| 3,754,396 | 8/1973 | Erma | 91/234 X |

FOREIGN PATENT DOCUMENTS

| | | | |
|---|---|---|---|
| 122012 | 8/1901 | Fed. Rep. of Germany | 91/234 |

*Primary Examiner*—Edward K. Look

*Attorney, Agent, or Firm*—Cushman, Darby & Cushman

[57] ABSTRACT

A pneumatic type of reciprocating movement device capable of a high cycle speed over a short stroke. A rod member with a flange is slidably mounted in a cylinder member such that the flange divides a cavity in the cylinder into a left and right portion. Intake and exhaust passages are moved in and out of communication with the cavity sides by the moving interface of the rod and cylinder, such that an alternating force is exerted on the flange sides causing the flange and rod member to move in a reciprocating motion without the use of an auxiliary system of valve switching.

3 Claims, 3 Drawing Sheets

PNEUMATIC TYPE OF RECIPROCATING MOVEMENT DEVICE

BACKGROUND OF THE INVENTION

The structure of the present invention resembles a linear movement cylinder. In the conventional cylinder, the position of the intake and exhausting ports have to be interchanged by means of some auxiliary parts, if the moving direction of the piston has to be changed. Such auxiliary parts may be an electro-magnetic valve or a pneumatic hammer type of automatic valve; however, such additional auxiliary parts are not good for high speed change of direction, and for short stroke distance operation.

In view of the aforesaid drawbacks of the valves in the conventional cylinder, the inventor has developed the present invention, which is a reciprocating movement cylinder to be operated at a high speed and at a short stroke distance. The aforesaid high speed and short stroke features are achieved by means of the corresponding passages and openings on the slidable surface between the cylinder and the piston. When the flowing direction of the air is changed via the aforesaid passages and openings, the moving direction of the piston will also be changed, whereby the reciprocating movement is achieved.

SUMMARY OF THE INVENTION

This invention relates to a reciprocating movement device, and particularly to a pneumatic type of linear reciprocating movement device. The typical function of this invention is used as a polishing tool, i.e., a tool operating at high speed and short stroke reciprocating movement.

The object of the present invention is to provide a pneumatic cylinder, which can move reciprocatingly without using direction-switching values. Particularly, the present invention is a pneumatic type of cylinder to provide a reciprocating movement at a high speed and short stroke distance. The direction change of the pneumatic stream is to be done by means of the passages and openings on the slidable surface between the cylinder and the piston. The present invention is a pneumatic type of reciprocating device with a simple structure.

The present invention comprises: a cylinder member having a through hole along axial direction of the cylinder member, and the midportion of the through hole being formed into a cavity with a large diameter; a rod member being slidably moved axially inside the aforesaid cylinder member; a flange being slidable mounted in the cavity portion of the cylinder member to partition the portion into a left and a right cavities. On the slidable surface between the rod member and the cylinder member, there are four sets of passages, which can be aligned in communication condition, or non-aligned in closed state. Two sets of the passages are to be in communication condition, when the rod member moves towards the left cavity, so as to cause the compressed air to enter the left cavity, and to have the air in the right cavity exhausted. The other two sets of passages are to be in communication condition, when the rod member moves towards the right cavity, so as to cause the compressed air to enter the right cavity, and to have the air in the left cavity exhausted; as a result, the rod member and the cylinder member can generate a relative reciprocating movement. The two intake passages and the two exhausting passages may be connected together respectively via one intake port and one exhausting port on the rod member or on the cylinder member. The rod member not only can move relatively to the cylinder member axially, but also can rotate relatively to each other, or means can be installed to prevent rotation in applications where it is not desirable.

DETAILED DESCRIPTION

Figure 1:
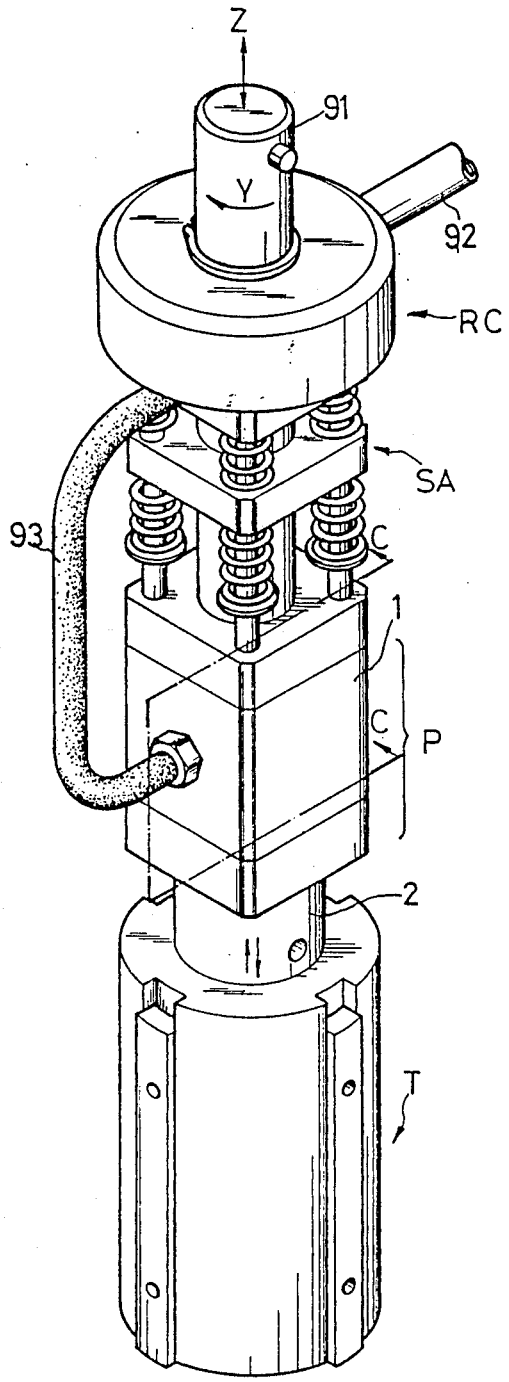
FIG. 1 is a perpective view of the first embodiment according to the present invention, being used in a polishing tool; in that embodiment, the rod member and the cylinder member must not rotate relatively each other.

FIG. 1 illustrates the first embodiment of the device P according to the present invention, in which the rod member 2 (inner rod) is connected with a polishing head T mounted external to a cylinder member 1 (an outer body) of the device P, being moved reciprocating by and axially relative to the cylinder member 1. The cylinder member 1 does not rotate relatively to the rod member 2. The cylinder member 1 is connected with a driving shaft 91 via a shock absorber SA so as to rotate at a suitable speed and to make axial adjustment if necessary as shown with arrows Y and Z for making a polishing operation with the polishing head T. The air-pressure source for the device is supplied through a pipe 92, a rotary connector RC, and a tube 93, being conveyed inside the cylinder member 1. The structure of the device P is shown in FIG. 2, which is a sectional view taken along line c—c in FIG. 1.

Figure 2:
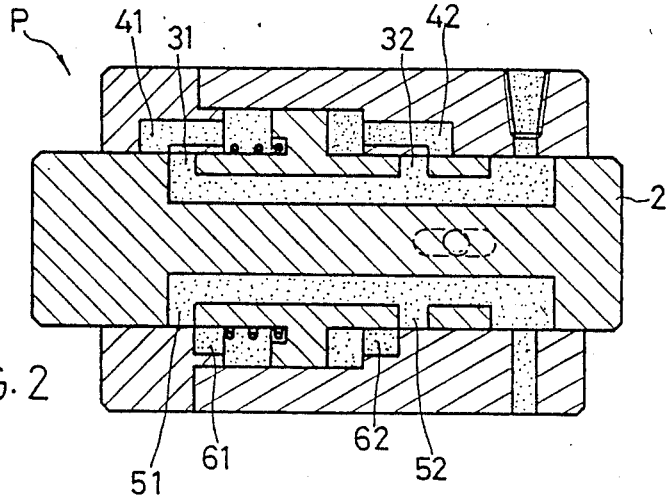
FIG. 2 is a sectional view taken along line c—c as shown in FIG. 1.

FIG. 2 illustrates the structure of the device P, which comprises a cylinder member 1 and a rod member 2. The cylinder member 1 as shown in FIG. 1 is a fixed part, while the rod member 2 moves reciprocatingly on the cylinder member 1. The air-pressure source a is introduced in through an intake 10, and intake passage 3, to two intake openings 31 and 32. The two openings 31 and 32 can connect with two passages 41 (shown in FIG. 4) and 42 (shown in FIG. 3) respectively at suitable times. Both of the two passages 41 and 42 can be in communication with the left cavity 1 and the right cavity r partitioned with a central flange 22, which is subject to being pushed leftwards or rightwards. On the opposite side of the intake portion, there are two passages 61 and 62, which can become connected and communicating with opening 51 (shown in FIG. 3) and opening 52 (shown in FIG. 4) on the rod member 2. The openings 51 and 52 are in communication with an exhausting passage 5 furnished on the rod member 2 for exhausting air out of the exhausting port 11 as shown with arrow e. At a suitable position between the cylinder member 1 and the rod member 2, there is a salient portion 15 and a recessed portion 25 for preventing the cylinder member and the rod member from rotating relatively.

Figure 3:
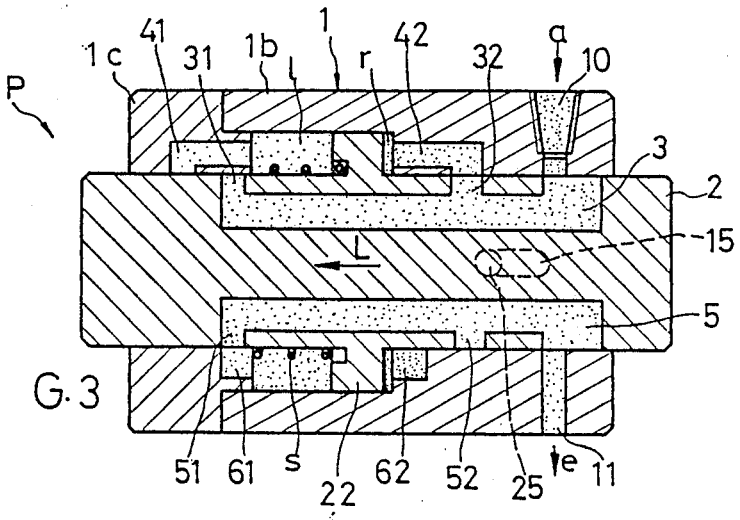
FIG. 3 is a sectional view as shown in FIG. 2 in which the rod member in the right cavity is being moved towards the left cavity as a result of an air pressure.
Figure 4:
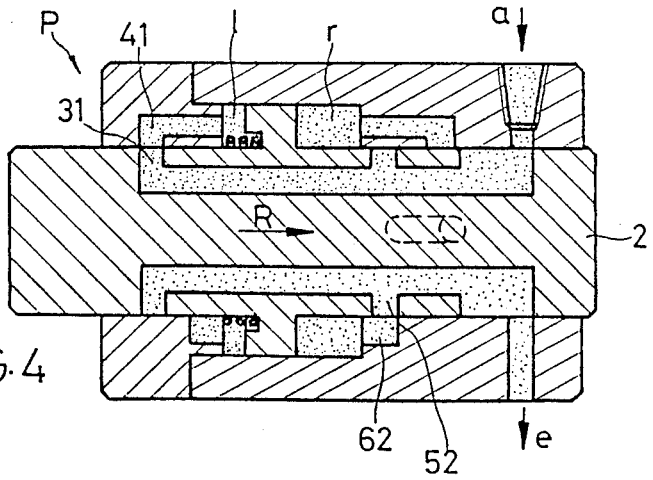
FIG. 4 is a sectional view as shown in FIG. 2, in which the rod member in the left cavity being moved towards the right cavity as a result of an air pressure.

FIG. 3 illustrates that opening 32 is in communication with the passage 42 when the rod member 2 biasing towards the right cavity r so as to let air enter the right cavity r; simultaneously, the air in the left cavity 1 will be exhausted through passage 61, and opening 51 to cause the rod member 2 to move leftwards as shown with arrow L. When the rod member 2 moves to the center position as shown in FIG. 2, the intake openings and exhausting passages and openings 31, 41, 32, 42, 51, 61, 52 and 62 will be closed. As a result of the inertia effect, the rod member 2 would continue to move leftwards as shown in FIG. 4. When the rod member 2 is biased at the left cavity 1 side, the intake opening 31 and the passage 41 are set in communication condition, and the exhausting passage 62 and the opening 52 are also set in communication condition so as to provide a force to cause the rod member 2 to move rightwards as shown with arrow R; then, the rod member will move from the position shown in FIG. 2 to the position shown in FIG. 3 and repeat. In order to prevent the rod member 2 from stopping at the position as shown in FIG. 2 in case of the air supply being interrupted abruptly causing the device to be unable to start, there is a compression spring S installed between the rod member 2 and the cylinder member 1 so as to have the rod member 2 always stop on one side in order to insure the device is started again smoothly. The rod member 2 has a flange 22. The cylinder member 1 substantially comprises an opening cavity **1*b* and a cover plate 1*c* as shown FIG. 3**.

Figure 5:
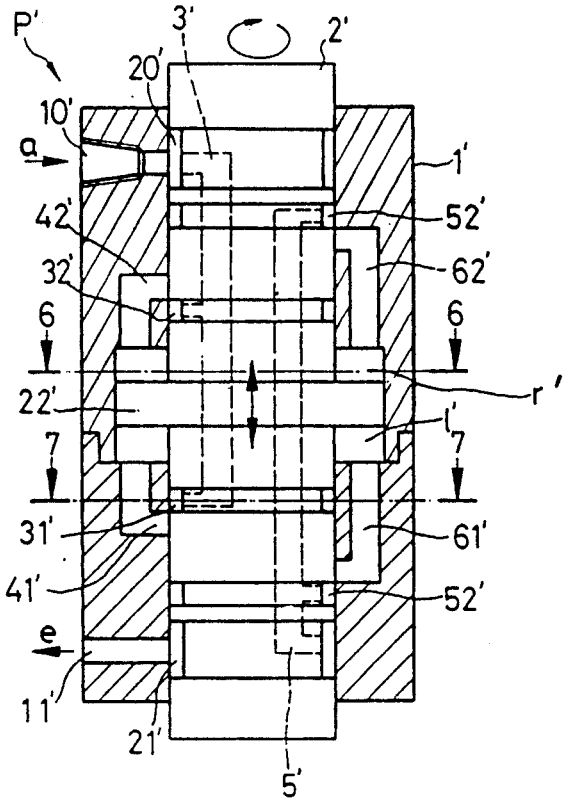
FIG. 5 is a longitudinal sectional view of the second embodiment of the present invention.
Figure 6:
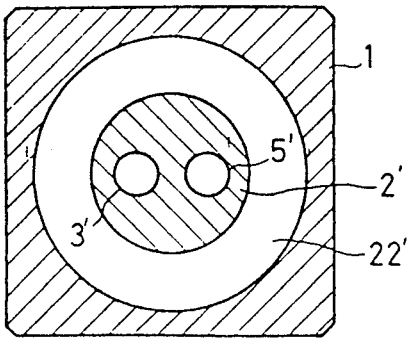
FIG. 6 is a sectional view taken along line 6—6 in FIG. 5.
Figure 7:
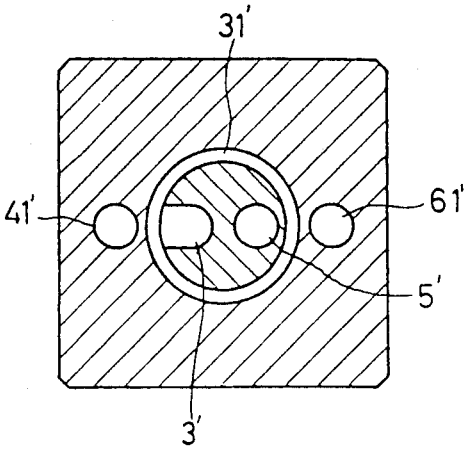
FIG. 7 is a sectional view taken along 7—7 in FIG. 5.

FIGS. 5, 6 and 7 illustrate the second embodiment of device P' according to the present invention, which comprises a cylinder member 1' and a rod member 2'; both of the two members can rotate relatively, and can make a reciprocating movement by means of an air pressure. Both the cylinder member 1' and the rod member 2' have the same intake port 10' and exhausting port 11', the intake passage 3', 41' and 42', the exhausting passages 5', 61' and 62', the flange 22', the left and right cavities 1' and r' as those of the first embodiment of the present invention. However, in order to facilitate the connection among pipes during relative rotation between the cylinder member and the rod member, the outer surface of the rod member 2' is furnished with a plurality of circular grooves 31', 32', 51' and 52', and intake grooves 20' and 21', whereby the air "a" can enter the left and right cavities l' and r' via the intake passage 3', and then the air can be exhausted via the exhausting passage 5' to enable the reciprocating movement.

I claim:

1. A pneumatic type reciprocating device comprising:

a cylinder member having a through bore, said through bore being of larger diameter at the center of said cylinder member than at both ends of said cylinder member so as to form a cavity in the center of said cylinder member, said cylinder member having an exhaust port and an intake port, each extending radially from an inside surface of said cylinder member, said intake port being connected to a source of pressurized fluid and said exhaust port being connected to ambient surroundings of said device, a rod member slidably mounted inside said through bore of said cylinder member, said rod member and said cylinder member being sized so as to form an air tight said in said cavity while allowing said rod member to move axially within said cylinder member, said rod member containing a communication passage for intake of a working fluid into said cavity and a communication passage for exhaust of a working fluid out of said cavity, said communication passage for the intake being in communication with said intake port for all positions of said rod member relative to said cylinder member and said communication passage for the exhaust being in communication with said exhaust port for all positions of said rod member relative to said cylinder member, said communication passages terminating at one or more positions on a surface of said rod member at an interface of said rod member and said cylinder member, a flange member fixed coaxially, and at the center of said rod member such that it divides said cavity into left and right portions, right and left intake passages on said cylinder member communicating to the left said and right side of said cavity respectively, each of said intake passages also communicating to respective positions along the interface of said cylinder member and said rod member, configured so as to allow the right intake passage to be aligned with said communiction passage for intake, at the interface of said cylinder member and said rod member, when said flange is displaced to a predetermined position right of center of said cavity and the left intake passage to be aligned with said communication passage for intake, at the interface of said cylinder member and said rod member, when said flange is displaced to a predetermined position left of center of said cavity, and right and left exhaust passages on said cylinder member, communicating to said right side and said left side of said cavity respectively, said exhaust passages also communicating respectively to positions along the interface of said rod member and said cylinder member, configured so as to allow said right exhaust passage to align with said communication passage for the exhaust when said flange is displaced to the left side of said cavity and said left exhaust passage to align with said communication passage for the exhaust when said flange is displaced to the right side of said cavity, resulting in an alternating force being applied to the sides of said flange causing said flange and said rod member to move in a reciprocating fashion.

2. A device as claimed in claim 1, wherein:

said cylinder member is formed so as to have a salient portion extending from an inside surface of said cylinder member radially inward, and said rod member is formed so as to have a recessed portion opposite said salient portion and engaging with said salient portion so as to prohibit relative rotation between said cylinder member and said rod member while allowing axial movement of said rod member within said cylinder member.

3. A pneumatic type of reciprocating device as claimed in claim 1, further comprising;

a compression spring fitted between said rod member and said cylinder member causing said flange to be decentralized in said cavity in the case of loss of external fluid pressure.

* * * * *